US006217254B1

(12) United States Patent
Wallgren et al.

(10) Patent No.: US 6,217,254 B1
(45) Date of Patent: Apr. 17, 2001

(54) MARKING ON ROADS WITH A FIXED ROAD SURFACE, SUCH AS ASPHALT, CONCRETE OR THE LIKE FOR MOTOR VEHICLES AND METHOD FOR PRODUCING ROAD MARKINGS

(75) Inventors: Magnus Wallgren; Toni Ogemark, both of Kristianstad (SE)

(73) Assignee: Cleanosol AB (SE)

( * ) Notice: Subject to any disclaimer, the term of this patent is extended or adjusted under 35 U.S.C. 154(b) by 0 days.

(21) Appl. No.: 09/599,825

(22) Filed: Jun. 22, 2000

(30) Foreign Application Priority Data

Jun. 30, 1999 (SE) ..... 9902483

(51) Int. Cl.[7] ..... E01C 23/16
(52) U.S. Cl. ..... 404/93; 404/14; 404/19
(58) Field of Search ..... 427/137, 202, 427/203, 204, 205; 404/93, 94, 72, 14, 19

(56) References Cited

U.S. PATENT DOCUMENTS 3,855,444 * 12/1974 Palena ..... 219/76
4,373,670 * 2/1983 Kilner ..... 239/172
4,839,198 * 6/1989 Lonis et al. ..... 427/137
4,856,931 * 8/1989 Bollag ..... 404/75
5,203,923 * 4/1993 Hartmann ..... 118/669
5,395,673 * 3/1995 Hunt ..... 428/148
5,511,896 * 4/1996 Marcato ..... 404/72
5,599,133 * 2/1997 Costello et al. ..... 404/72
5,601,900 * 2/1997 Doscher ..... 428/149

* cited by examiner

*Primary Examiner*—David Bagnell
*Assistant Examiner*—Raymond W Addie
(74) *Attorney, Agent, or Firm*—Lerner, David, Littenberg, Krumholz & Mentlik, LLP

(57) ABSTRACT

Road markings disposed on a fixed road surface are disclosed including reflective material disposed on a first portion of the fixed road surface for improving light reflection and friction material disposed on a second portion of the fixed road surface for increasing the friction between the fixed road surface and the wheels of a vehicle, these two portions of the road surface being separate portions of the fixed road surface. Methods are also disclosed for disposing road markings on a fixed road surface.

9 Claims, 1 Drawing Sheet

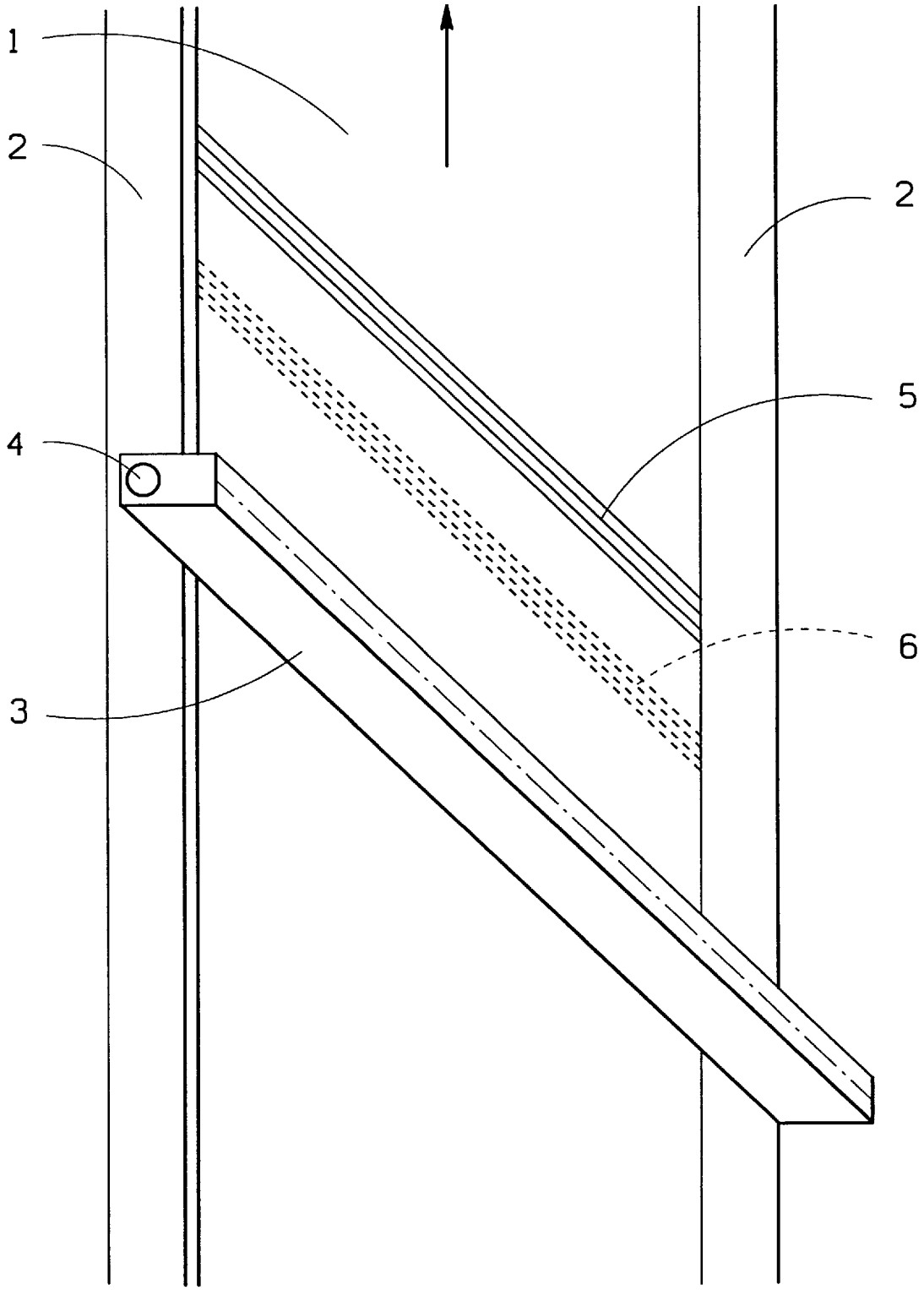
1
2
2
5
4
6
3

MARKING ON ROADS WITH A FIXED ROAD SURFACE, SUCH AS ASPHALT, CONCRETE OR THE LIKE FOR MOTOR VEHICLES AND METHOD FOR PRODUCING ROAD MARKINGS

FIELD OF THE INVENTION

The present invention relates to road markings on roads which have a fixed road surface, such as asphalt, concrete and the like and which are used by motor vehicles, bicycles and other vehicles. These road markings are intended to guide and to inform traffic and they must therefore be able to be seen by drivers both in daylight and at night, and in rain or other inclement weather. They are therefore provided at the surface with reflecting material so that light can be reflected, but also with friction material for increasing the friction, so that the road markings will have a friction corresponding to that of the surrounding surfacing.

BACKGROUND OF THE INVENTION

The abovementioned road markings have been known for many years. The reflecting materials used are preferably glass beads or ceramic materials which are embedded in a binder in the marking but which protrude above the surface of the binder so that light can hit them and can be reflected back to the driver of a vehicle. These glass beads, as well as the binder, can have different compositions, but they are preferably made so that they reflect visible light.

The remainder of the roadway outside of these road markings must have as high a friction as possible in relation to the wheels of the vehicles driving on the road. However, a road marking generally consisting of thermoplastic with glass beads applied to the road surface creates a lower friction on this marking than on the rest of the road surface, for which reason it is also customary to apply a friction-enhancing material in or on the road marking. This material often consists of crushed glass, corundum or other stone material.

When applying both reflecting material and friction material, however, a problem arises because there is considerably poorer visibility in the dark compared to those cases where only reflecting material has been applied. The poorer visibility is caused by the fact that the friction particles shade the light from vehicles so that there is less possibility of the light being reflected back to the vehicle drivers.

SUMMARY OF THE INVENTION

In accordance with the present invention, it has now been found possible to apply both reflecting material and friction-enhancing material without the visibility of the road markings being reduced to an unacceptable level. In accordance with this invention, this has been accomplished by the discovery of road markings disposed on a fixed road surface comprising reflective material disposed on a first portion of the fixed road surface for improving light reflection thereon and friction material disposed on a second portion of the fixed road surface for increasing the friction between the fixed road surface and the wheels of a vehicle, the first and second portions of the fixed road surface being separate portions of the fixed road surface. In a preferred embodiment, the fixed road surface is asphalt or concrete.

In accordance with one embodiment of the road markings of the present invention, the first and second portions of the fixed road surface comprise shaped portions thereof.

Preferably, the shaped portions of the fixed road surface comprise strip-shaped portions thereof.

In accordance with another embodiment of the road markings of the present invention, the reflective material and the friction material are applied to the fixed road surface by sprinkling or by application of compressed air supplied by a nozzle.

In accordance with another embodiment of the road markings of the present invention, the reflective material comprises glass beads and the friction material is crushed glass or stone, such as corundum.

In accordance with the present invention, a method has been devised for disposing road markings on a fixed road surface comprising first applying a friction material onto a first portion of the fixed road surface with the friction material in a tacky state, and subsequently applying a reflective material to the entire fixed road surface while the friction material remains in the tacky state whereby the reflective material adheres to a second portion of the fixed road surface and does not adhere to the first portion of the fixed road surface.

In accordance with the present invention, a method has also been devised for disposing road markings on a fixed road surface comprising first applying a reflective material onto a first portion of the fixed road surface with the reflective material in a tacky state, and subsequently applying a friction material to the entire fixed road surface while the reflective material remains in the tacky state, whereby the friction material adheres to a second portion of the fixed road surface and does not adhere to the first portion of the fixed road surface.

According to the present invention, road markings are used on roads with a fixed road surface, such as asphalt, concrete or the like for motor vehicles, comprising reflecting material for better reflection of light and friction material for increasing the friction between the roadway and the vehicle wheels, and on which the reflecting materials and the friction materials are separate from each other and form separate portions.

According to the present invention, it is preferable for the friction and reflecting materials to be applied in the form of strips or separate patches of different shapes.

According to the present invention, the friction material and the reflecting materials on the surface of the road marking have preferably been applied by the so-called drop-on method (sprinkling), or by means of compressed air and nozzles.

According to the present invention, the reflecting material preferably comprises glass beads and the friction material comprises crushed glass, corundum or other stone material.

The present invention also relates to a method for producing road markings of the abovementioned type, in which the friction material is first applied in portions on the marking, and the reflecting material is thereafter sprinkled across the whole surface while it is still tacky, and the reflecting material does not adhere on those portions which have first been sprinkled with friction material, or vice versa.

DESCRIPTION OF THE FIGURE

The present invention will be described in greater detail below with reference to the following detailed description, which refers to the FIGURE, which is a diagrammatic representation of a method for a prefabricated road marking according to the present invention.

DETAILED DESCRIPTION

The road markings according to the present invention include both prefabricated road surfacings and those which are applied in situ on the roadway. They generally consist of some form of thermoplastic, cold plastic, paint, tape, etc., which is arranged or formed in the molten state and which is applied to the surface means while the thermoplastic is still tacky, so that the surface means can, at least in part, penetrate into the thermoplastic and become anchored in a reliable manner. These road markings and the reflecting materials and the friction-enhancing materials are known, and do not constitute part of the present invention. The reflecting materials generally consist of glass beads of different composition, whereby they can reflect both normal light during the daytime or at night, and also UV light which passes through fog and other visibility-reducing substances. The friction materials are also well known, namely crushed glass, corundum or other stone material in crushed form, but the present invention is not limited to the use of these known materials.

The road markings according to the present invention can be produced as prefabricated markings in the factory, or they can be produced in situ on the roadway. If produced in the factory, the material mixture constituting the marking is arranged on a running belt under a nozzle and is allowed to harden on the belt before being picked off. When applied in situ on the roadway, it is instead a machine which moves and arranges the material mixture on the roadway using in principle the same procedure as in factory production. According to the prior art, the reflecting material and the friction-enhancing material are sprinkled in the form of a mixture on the low-viscosity surface of the road marking material. This sprinkling is carried out in principle in the same way both in factory production and during in situ formation on the roadway, but with the difference that in the former case the marking moves in relation to the sprinkler arrangement, while in the latter case the reverse is true. In both cases, the sprinkler arrangement itself consists in principle of an elongated container constituting a material magazine with a longitudinal slit in the base and a rotating roller near the slit which guides the material down and sprinkles it out through the slit.

The FIGURE shows an arrangement for producing prefabricated road markings according to the present invention. The FIGURE shows a material web 1 which moves in the direction of the arrow between two edge strips 2 on a running belt. A material reservoir 3 is arranged above the material web 1. This material reservoir 3 extends across the whole of the material web 1 and has a slit (not shown) in the base. A roller 4 is arranged to rotate in the lower part of the material container 3. The jacket surface of this roller is provided with grooves of desired configuration, in which grooves the material accumulates and is emptied out through the slit. It is important for a scraper arrangement to bear against the jacket surface of the roller 4 so that material which is not situated in the grooves does not emerge through the slit. The grooves can be continuous and provide continuous strips 5, or they can be intermittent and provide interrupted strips 6. Any other configuration of the grooves is of course possible.

After the friction material has been arranged in the form of the strips, 5 or 6, for example, the reflecting material is arranged uniformly across the whole surface while it is still tacky. This means that the reflecting material is provided everywhere except at those places where the friction material has already coated the surface. The glass beads which fall onto the friction material roll off immediately. The same technique, but with a displaceable material container 3, is used for producing road markings in situ, but with the difference that the material container 3 moves in relation to the surface 1.

The density of the portions and their sizes can be regulated by different designs of the grooves in the roller and the speed at which the roller rotates and the relative speed of the marking web 1 in relation to the material container 3. It is also possible to arrange two or more application arrangements in succession in order to apply different types of drop-on material, for example different types and fractions of beads and/or different types and fractions of friction material. Thus, it is possible to use the technique in order to improve the visibility of the markings in the dark and in wet weather or rain by using large drop-on beads, preferably with sizes of over 0.7 mm. The advantage of applying the large beads in portions is that in this way it is possible to avoid adverse effects (shadowing from small beads) and at the same time it is possible to reduce the cost compared to using large beads across the whole of the marking surface. Large beads are more expensive than small beads.

By means of the present invention it has been made possible to increase the friction on the road markings without reducing the retroreflection to an unacceptable extent. Thus, it has been possible to achieve a friction value of 55 SRT (Skid Resistance Test according to EN1436) for a surfacing according to the present invention, compared with a value of 43 SRT for a road marking with only glass beads. EN1436, which is a European standard for road markings, stipulates for class R5 a value of 55, which is thus satisfied.

The retroreflection in the present case was 380 RL (Reproreflective Luminescence according to EN1436), compared with a value of 449 for glass beads alone. The value according to the present invention satisfies the requirements of class S3 according to EN1436.

By means of the present invention, it has thus been made possible to provide road markings of a variable type in which both friction and retroreflection can be varied and which can be produced both in the factory or in situ on the roadway.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Road markings disposed on a fixed road surface comprising reflective material disposed on a first portion of said fixed road surface for improving light reflection thereon and friction material disposed on a second portion of said fixed road surface adjacent said first portion for increasing the friction between said fixed road surface and the wheels of a vehicle, said first and second portions of said fixed road surface being separate portions of said fixed road surface.

2. The road markings of claim 1 wherein said fixed road surface comprises asphalt or concrete.

3. The road markings of claim 1 wherein said first and second portions of said fixed road surface comprise shaped portions thereof.

4. The road markings of claim 3 wherein said shaped portions of said fixed road surface comprise strip-shaped portions thereof.

5. The road markings of claim 1 wherein said reflective material and said friction material are applied to said fixed road surface by a method selected from the group consisting of sprinkling and application by compressed air supplied by a nozzle.

6. The road markings of claim 1 wherein said reflective material comprises glass beads and said friction material is selected from the group consisting of crushed glass and stone.

7. The road markings of claim 6 wherein said stone comprises corundum.

8. A method for disposing road markings on a fixed road surface comprising first applying a friction material onto a first portion of said fixed road surface with said friction material in a tacky state, and subsequently applying a reflective material to said entire fixed road surface while said friction material remains in said tacky state whereby said reflective material adheres to a second portion of said fixed road surface and does not adhere to said first portion of said fixed road surface.

9. A method for disposing road markings on a fixed road surface comprising first applying a reflective material onto a first portion of said fixed road surface with said reflective material in a tacky state, and subsequently applying a friction material to said entire fixed road surface while said reflective material remains in said tacky state, whereby said friction material adheres to a second portion of said fixed road surface and does not adhere to said first portion of said fixed road surface.

* * * * *

UNITED STATES PATENT AND TRADEMARK OFFICE

CERTIFICATE OF CORRECTION

PATENT NO. : 6,217,254 B1
DATED : April 17, 2001
INVENTOR(S) : Wallgren et al.

It is certified that error appears in the above-identified patent and that said Letters Patent is hereby corrected as shown below:

Title page, Item [54], and Column 1, line 1,
"MARKING" should read -- MARKINGS --.

Signed and Sealed this

Twenty-seventh Day of May, 2003

JAMES E. ROGAN
*Director of the United States Patent and Trademark Office*